US005201658A

United States Patent [19]

Taylor et al.

[11] Patent Number: 5,201,658

[45] Date of Patent: Apr. 13, 1993

[54] ARTILLERY GUN SIMULATOR HAVING FIXED GUN TUBE AND RECOILING BREECH ASSEMBLY

[75] Inventors: Stephen P. Taylor, Hurstpierpoint; Douglas J. Steptoe, Horsham, both of England; Patrick J. Morello, Deltona, Fla.

[73] Assignee: ECC International Corporation, Orlando, Fla.

[21] Appl. No.: 793,476

[22] Filed: Nov. 18, 1991

[51] Int. Cl.[5] ..... F41A 33/00

[52] U.S. Cl. ..... 434/18; 434/16; 434/11

[58] Field of Search ..... 434/18, 16, 11, 24

[56] References Cited

U.S. PATENT DOCUMENTS

| | | | |
|---|---|---|---|
| 4,194,304 | 3/1980 | Wolcott | 434/18 |
| 4,591,342 | 5/1986 | Lipp | 434/18 |
| 4,812,122 | 3/1989 | Mueller | 434/18 |

FOREIGN PATENT DOCUMENTS

| | | | |
|---|---|---|---|
| 3345768 | 6/1985 | Fed. Rep. of Germany | 434/18 |
| 3631262 | 3/1988 | Fed. Rep. of Germany | 434/18 |

*Primary Examiner*—Gene Mancene

*Assistant Examiner*—Jeffrey A. Smith

*Attorney, Agent, or Firm*—James H. Beusse

[57] ABSTRACT

An artillery simulator apparatus is provided including a gun tube which is swingably mounted to a rotatable cab. During simulator recoil and counter-recoil, the gun tube is held in fixed position while the breech moves under computer control from an "in battery" position to a recoil position and then back to the "in battery" position. Breech recoil speed and stroke are controlled to simulate actual M109 breech performance based on propelling charge, type round, and gun tube elevations. A double acting hydraulic cylinder is attached to the breech to drive the breech in the recoil and counter-recoil directions. During recoil and counter-recoil, the hydraulic cylinder is positively driven by fluid from the same hydraulic source. The simulator includes sensors for determining the type of round placed in the breech, the round fuse type and run time setting, the firing primer, as well as the level of propelling charges in the breech. The simulator also includes apparatus for expelling the simulated primer, propelling charges, and round from the simulator after firing, and apparatus for moving the spent propelling charges and round to a storage area.

5 Claims, 7 Drawing Sheets

ARTILLERY GUN SIMULATOR HAVING FIXED GUN TUBE AND RECOILING BREECH ASSEMBLY

BACKGROUND OF THE INVENTION

This invention relates in general to military simulators and, more particularly, to computer controlled artillery crew trainers which simulate gun recoil and counter-recoil effects.

Over the years many approaches have been tried in attempting to simulate the recoil and counter-recoil actions of field artillery pieces. One early approach was to employ chains or cables to slowly pull backward those parts of a gun which recoil and counter-recoil. In that approach, when the chains or cables are released, the gun tube moves forward simulating the counter-recoil action which is experienced after the gun is fired. Unfortunately, such an approach fails to effectively simulate the recoil portion of the gun firing sequence.

It is desirable that an artillery simulator mimic the actual routine of loading and firing the weapon as closely as possible. Dummy rounds can be used at relatively low cost to simulate the size, shape and weight of live rounds. Unfortunately, however, when such dummy rounds or rounds with reduced propellant charges are fired, the gun crew does not experience the same recoil and counter-recoil which they would experience when firing live rounds in combat.

Some artillery simulators have employed a complex hydraulic apparatus to simulate the recoil and counter-recoil action of artillery pieces without the need for firing live rounds. Such simulators have generally moved the gun barrel back and forth to correspond to recoil and counter-recoil effects. However, such a moving gun barrel represents a potentially dangerous situation when the simulator is used in relatively confined quarters.

SUMMARY OF THE INVENTION

One object of the present invention is to provide an artillery training simulation apparatus which employs a more integrated, yet unique, hydraulic system to move the breech of a gun through the recoil and counter-recoil motions when a simulated projectile is fired by the gun.

Another object of the present invention is to provide a less dangerous artillery training simulation apparatus wherein the gun tube remains stationary while the breech mechanism reciprocates to emulate recoil and counter recoil.

Yet another object of the present invention is to provide an artillery training apparatus in which different types of projectiles are provided with different frequency resonant circuits to assist the gun in identifying the particular type of projectile which the user has loaded into the gun.

Still another object of the invention is to provide an artillery training apparatus which includes a mechanism for automatically expelling and collecting the fired round for re-use at a later time.

In accordance with the present invention, an artillery gun simulator apparatus is provided which includes a gun tube. The simulator includes a support structure connected to the gun tube for providing support to the gun tube. The simulator further includes a breech assembly, for receiving a simulated round therein, such breech assembly being movably mounted with respect to the tube such that the breech assembly is movable between an "in battery position" and a "recoil position" by reciprocating action. The simulator includes a source of pressurized hydraulic fluid and a double acting hydraulic cylinder, mechanically coupled to the breech assembly and fluidically coupled to the source such that the source positively drives the cylinder and breech assembly from the "in battery position" to the "recoil position" to simulate breech recoil and then the source positively drives the cylinder and breech assembly from the "recoil position" to the "in battery position" to simulate breech counter-recoil.

BRIEF DESCRIPTION OF THE DRAWINGS

The features of the invention believed to be novel are specifically set forth in the appended claims. However, the invention itself, both as to its structure and method of operation, may best be understood by referring to the following description and accompanying drawings in which:

DETAILED DESCRIPTION OF THE INVENTION

Figure 1:
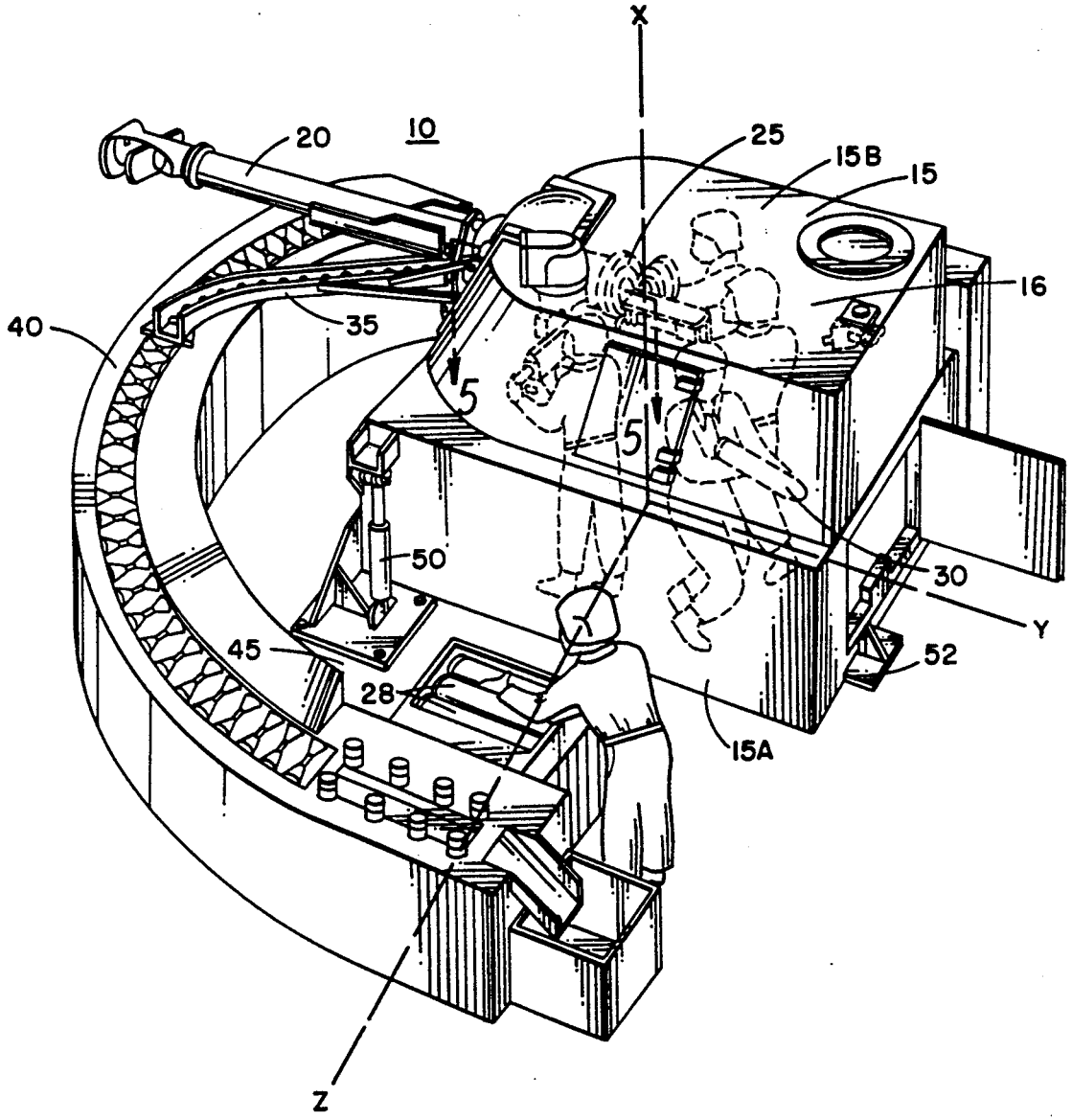
FIG. 1 is a perspective representation of the artillery simulator of the present invention.

FIG. 1 shows a perspective representation of the artillery simulator 10 of the present invention. To provides spacial references for the following discussion of simulator 10, an xyz coordinate system is depicted in FIG. 1. Simulator 10 includes a cab 15, which is rotatable in the azimuth (or yz) plane, as described later in more detail, and a hull 16 in which the gun crew stands. Simulator 10 further includes a gun tube 20 which is swingably mounted to cab 15 to enable the elevation of gun tube 20 to be adjusted in the xy plane. However, gun tube 20 is mounted to cab 15 in stationary fashion in the sense that tube 20 is not permitted to move back and forth along the y axis when the simulator emulates recoil and counter-recoil upon firing.

Simulator 10 includes a breech assembly 25 into which a round and charge are placed. As explained later in more detail, breech assembly 25 is movable between an "in battery position" and a "recoil position" in reciprocating fashion. A portion of the top of cab 15 is cutaway for convenience to enable breech assembly 25 to be more readily observed. After firing, round 28 is lowered from cab 15 down a chute 35 to a transport table 40. Transport table 40 moves the round and charge to a collection area 45 where such rounds are stored. Simulator 10 includes hydraulic actuators such as actuator 50 for controlling the pitch and roll of the simulator under computer control. The lower hull portion 15A of simulator 10 is swingably mounted on pitch and roll bearing 52.

Figure 2:
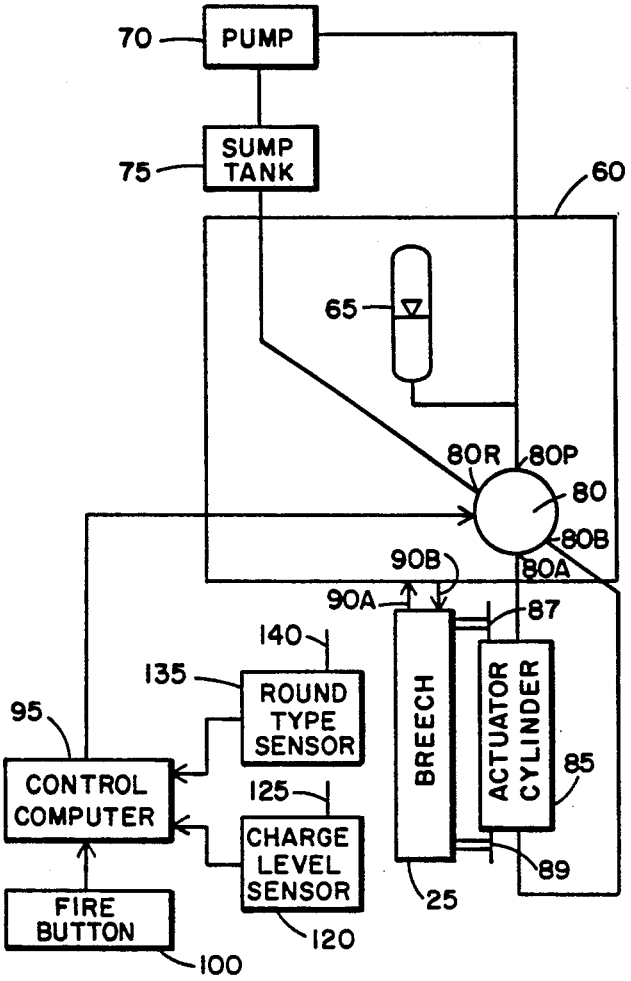
FIG. 2 is a simplified block diagram of the breech recoil portion or module of the simulator of FIG. 1.

FIG. 2 is a simplified block diagram of the breech recoil portion or module 60 of simulator 10. Breech recoil portion 60 moves breech assembly 25 from the "in battery" position to the "re-coil" position and then back to the "in battery" position when simulator 10 emulates round firing. Breech recoil module 60 includes a pressurized tank or accumulator 65 which is hydraulically coupled to a pressurized hydraulic fluid source such as pump 70/sump tank 75. The output of hydraulic fluid source 70 and accumulator 65 is coupled to a proportional control valve 80 including ports 80A and 80B, and ports 80P and 80R.

Breech recoil module 60 is in fluid communication with a double action hydraulic cylinder 85 capable of motion in either a first direction indicated by arrow 90A or in an opposite second direction indicated by arrow 90B depending on the direction of fluidic flow through cylinder 85. Breech 25 is shown in the "in battery" position in FIG. 2. Direction 90A corresponds to the direction of recoil from the "in battery" position to the "recoil" position and direction 90B corresponds to the direction of counter-recoil from the "recoil" position back to the "in battery" position.

Simulator 10 includes a control computer 95 which controls the operation of simulator 10 in the manner subsequently described. When control computer 95 senses that the operator has activated fire button (lanyard) 100, computer 95 issues a control signal to valve 80 which causes valve 80 to connect port 80P to port 80A and which further connects port 80B to port 80R (the return port). In so configuring valve 80, pressurized hydraulic fluid from pump 70/accumulator 65 flows from port 80P and out port 80A to positively drive the pistons 87 and 89 of cylinder 85 (and breech 25 coupled thereto) from the "in battery" position to the "recoil" position. Gun recoil in direction 90A is thus simulated. Fluid is forced out of cylinder 85 and through port 80B and return port 80R back to sump tank 75. The above described scenario defines the first half of the gun firing cycle.

After simulating recoil in the above described manner, computer 95 issues a control signal to valve which causes valve 80 to reverse hydraulic flow through cylinder 80 by connecting port 80P to port 80B and further connecting port 80A to return port 80R. By so configuring valve 80, hydraulic fluid from pump 70/accumulator 65 flows from port 80P and out port 80B to positively drive cylinder and breech 25 from the "recoil" position back to the "in battery" position. Gun counter-recoil in direction 90B is thus simulated. Fluid is forced out of cylinder 85 and through port 85B and return port 80R back to sump tank 75. The above described scenario defines the second half of the gun firing cycle.

Accumulator 65 stores sufficient energy to drive breech 25 through the entire recoil/counter-recoil gun firing cycle. More particularly, accumulator 65 may positively drive the pistons in cylinder 85 in both directions 90A and 90B without reliance on other pressurized fluid sources or fluid storage accumulators although pump 70 will assist if volume demand. In other words, fluid from accumulator 65 is continuously supplied to cylinder 85 throughout the gun firing cycle. Flow through cylinder 85 does, however, stop momentarily when valve 80 switches direction as described above.

One gun which simulator 10 of the present invention can emulate is the well known Model M109. The charge 30 which is employed in a M109 round includes a bundle of multiple charges in which individual charges are progressively removed from the bundle by the operator to provide charge levels lower than maximum, for example size 8. Each simulated charge is manufactured using a suitable fabric holder (charge bag) filled with inert plastic particles. The weight, size and coding of real charge bags are replicated by these simulated charges. In this particular embodiment of the invention, charge bags are not of equal size.

Figure 3C:
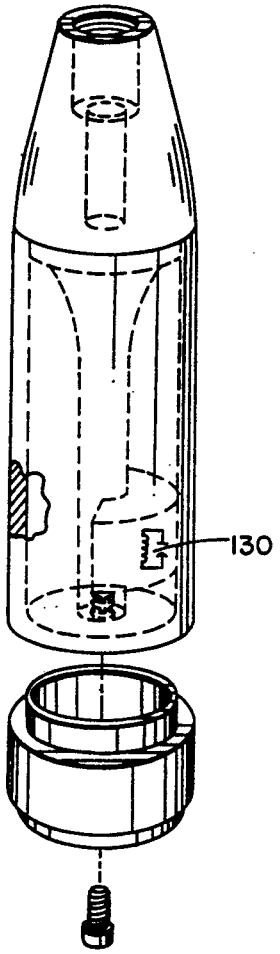
FIGS. 3A, 3B and 3C are simplified representations of a simulated charge and round which are employed in the simulator.
Figure 3A:
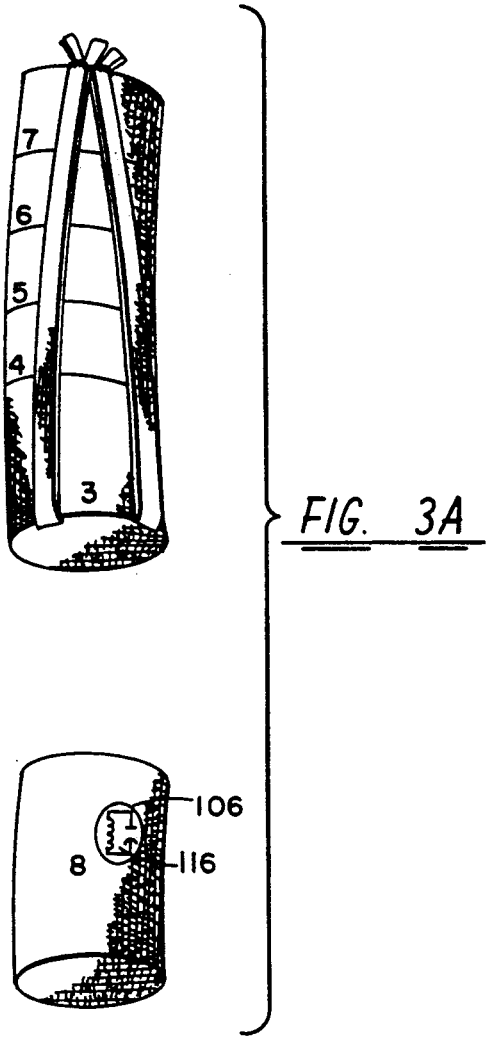
Figure 3B:
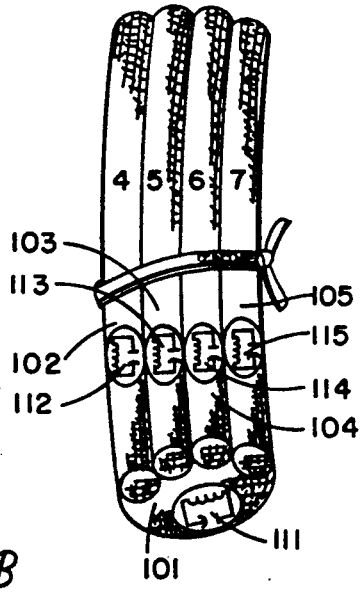

A simplified representation of two forms of charges 30 are shown in FIGS. 3A and 3B. Propelling charges are variably configured as a bundle of bags tied together. The smallest charge is size 3 and the largest is size 8. Charge size 8 consists of charge bags 3 through 7 plus supplementary charge bag size 8. Charge bags 3 through 7 are designated 101, 102, 103, 104 and 105 in FIG. 3A charge bag size 8 is designated 106. Each of charge bags 101–106 includes a respective passive LC resonant circuit 111–116 therein. Resonant circuits 111–116 each resonate at different frequencies (F1, F2–F6) such that they can be distinguished from one another. This enables the number of charge bags contained in a particular round 30 to be counted in the manner now described. The only difference between the form of charge bundle in FIGS. 3A and 3B can be seen to be whether the charge bags are stacked or arranged circumferentially.

The following Table 1 illustrates the relationship among charge bags 101–106, resonant circuits 111–116 and selected resonant frequencies, F1–F6.

TABLE 1

| CHARGE BAG | RESONANT CIRCUIT | RESONANT FREQUENCY |
|---|---|---|
| 101 | 111 | F1 |
| 102 | 112 | F2 |
| 103 | 113 | F3 |
| 104 | 114 | F4 |
| 105 | 115 | F5 |
| 106 | 116 | F6 |

When charge 30 is loaded into breech 25 of FIG. 2, charge sensor 120 senses each resonant frequency exhibited by the 7 charge bags 101–106. In more detail, charge sensor 120 is a radio frequency sweep generator to which an antenna 125 is coupled. As charge 30 is loaded into breech 25, charge sensor 120 sweeps through the radio frequencies F1 through F6. Each time one of resonant frequencies F1 through F6 is encountered by sensor 120, a tell-tale resonant frequency dip is detected by sensor 120 due to absorption of the sensor's transmitted signal by the resonant circuit. Correspondingly, each time sensor 120 detects such a dip, sensor 120 generates a digital pulse which is counted by control computer 95. Thus, if charge 30 includes 6 charge bags, 6 resonant frequency dips are detected by sensor and computer 95 counts 6 pulses from sensor 120. In another example, if charge 30 includes 4 charge bags, 4 resonant frequency dips are detected by sensor and computer 95 counts 4 pulses from sensor 120. In this manner, control computer 95 is apprised of the exact type of charge contained in any particular bundle 30 when such charge is loaded into breech 25.

Many different types of rounds 28 may be employed in simulator 10. For example, simulated incendiary, high explosive rounds, cargo and other types of rounds may be simulated. Simulator 10 is capable of detecting the different types of simulated rounds 28 which are loaded into breech 25. Referring to FIG. 3C, it is seen that round 28 includes a round type indicating resonant circuit 130. Resonant circuit 130 is a passive LC resonant circuit similar to resonant circuits 111–116 except that a single resonant circuit 130 is employed in each round 28. A different resonant frequency is used to indicate each different round type. Table 2 below provides some examples of typical shell types and corresponding selected resonant frequencies. It is noted that the resonant frequencies selected for round type indication are different from those selected in Table 1 for round charge level indication.

TABLE 2

| ROUND TYPE | RESONANT FREQUENCY |
|---|---|
| TYPE 1 | F1' |
| TYPE 2 | F2' |
| TYPE 3 | F3' |

For purposes of the subsequent discussion, it is assumed that TYPE 1 represents a high explosive type shell.

A round type sensor 135 is coupled to control computer 95 and to an antenna 140 as show in FIG. 2. Sensor 135 is a sweep generator similar to charge sensor 120. Round type sensor 135 sweeps through the F1', F2' and F3 ... resonant frequencies and transmits a radio frequency signal corresponding thereto. If a TYPE 1 round is loaded into breech 25, then sensor 135 will detect a resonant frequency dip at frequency F1' due to adsorption of that frequency by resonant circuit 130. Sensor 135 then communicates information to control computer 95 to indicate that a type 1 shell has been detected. In a similar manner, if an F2' resonant frequency dip is detected by sensor, then sensor communicates information to control computer 95 to indicate that a TYPE 2 shell has been detected.

Figure 12:
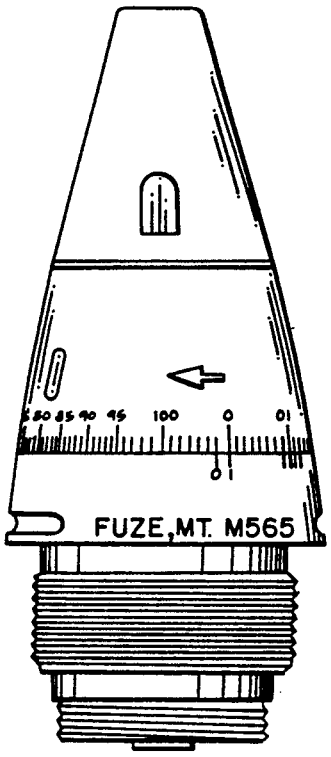
FIG. 12 is an illustration of an exemplary form of round fuse for use with the present invention.

In addition to the round type sensor, there is also provided similar frequency sensitive identifying circuits in fuses specially adapted to attach to the different types of rounds insertable into the breech assembly. Each of the fuses is formed to simulate an actual fuse to be attached to a combat round. An exemplary form of fuse is shown in FIG. 12. The fuse is adjustable to set a time delay, if desired. Internally, these fuses include a common type of passive transponder circuit, well known in the art, which can be interrogated by a predetermined frequency signal or digital code and will in turn generate a response code of predetermined characteristic. For example, the transponder circuit may generate a digital code such as a fourteen bit code in which a preselected number of bits, for example, four, identify the fuse type and the remaining bits identify the fuse time setting. The detection circuits for such transponders are also well known. In the present invention, the sensing circuit interrogates the fuse when it is inserted in the breech of the gun and transmits the return code to the control computer 95. The control computer may include detection means for identifying the predetermined code so as to identify the type of fuse inserted with the round and the time setting of the fuse. This information is then used, as with the other detected information about the round and charge, to evaluate the gun crews skill and ability in operating the gun.

Figure 4:
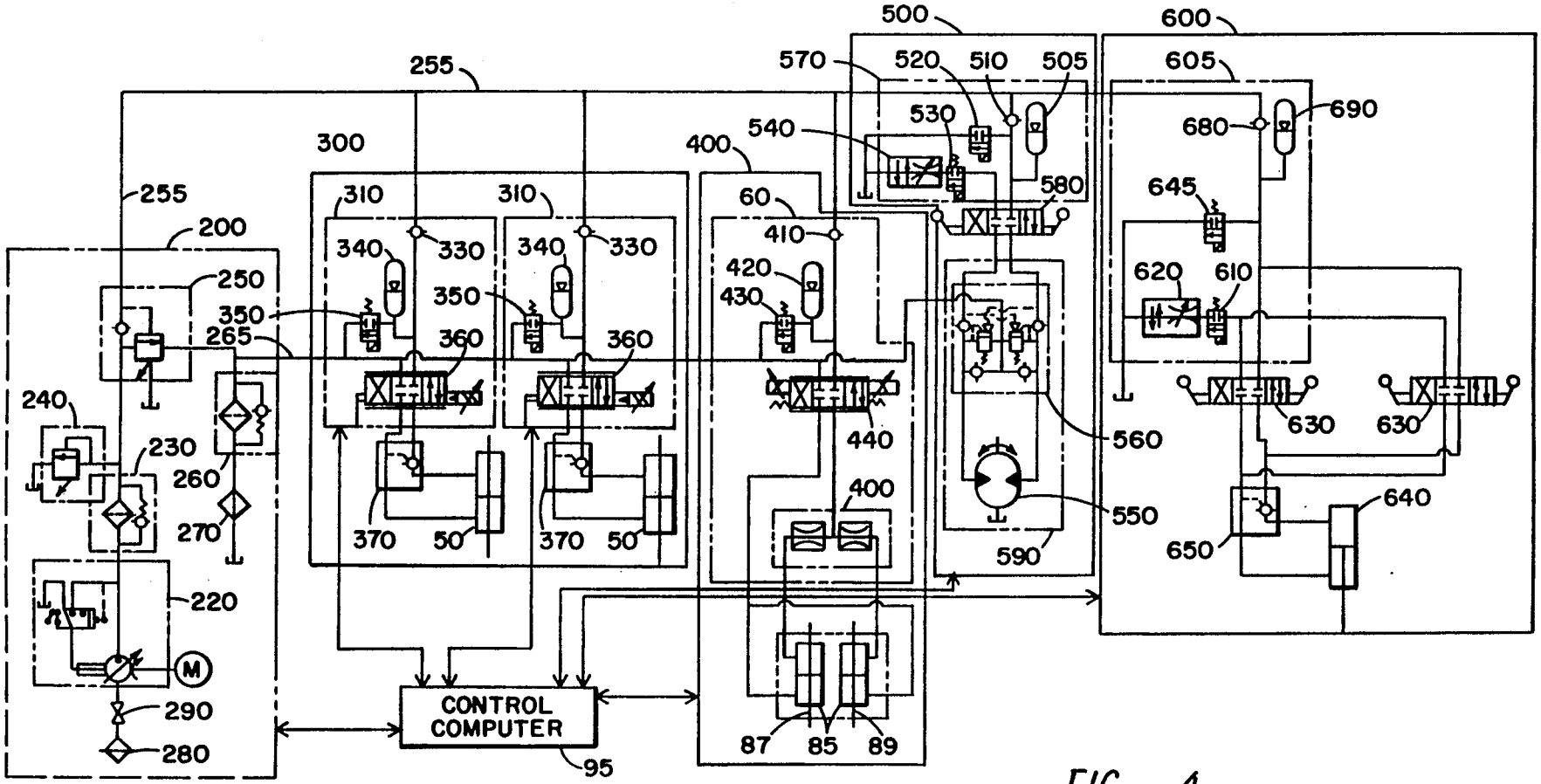
FIG. 4 is a detailed schematic diagram of the simulator of the present invention.

A detailed schematic diagram of simulator 10 of the present invention is shown in FIG. 4. In FIG. 4, the components depicted are illustrated in accordance with ISO (International Organization For Standardization) 1219.

One hydraulic power unit which may be used as a source of pressurized hydraulic fluid in place of pump 70 of FIG. 2 is shown in FIG. 4 as hydraulic power unit 200. Hydraulic power unit 200 includes a pump 220 fluidically coupled by a pressure filter 230, a relief valve 240 and a unloading relief valve 250 to a pressurized fluid output line 255. Hydraulic power unit 200 further includes a return filter 260 which is coupled to a return line 265 to receive hydraulic fluid returning from other parts of simulator 10. A cooler 270 is coupled to return filter 260 such that returned hydraulic fluid is cooled prior to being repressurized by unit 200. A sump strainer 280 is coupled to pump 220 by a shutoff valve 290.

In hydraulic power unit 200, hydraulic fluid is fed to pump 220 by the flooded inlet method. Sump strainer 280 prevents undesired particulate contaminants from being ingested by pump 220. Shutoff valve 290 is used for maintenance purposes and includes an electrical interlock to prevent start-up when valve 290 is closed. In this particular embodiment, pump 220 is as open circuit, pressure compensated axial piston pump. The hydraulic fluid is filtered by sump strainer 280 which is a high pressure filter incorporating an integral bypass valve. In this embodiment, valve 240 is a fast acting relief valve which is set at 500 psi over system pressure. Valve 240 is used to protect the hydraulic circuits of simulator 10 from pressure spikes which occur during operation of the hydraulic system of simulator 10. The unloading relief valve 250 limits the hydraulic system's maximum pressure and unloads pump 20 when the accumulators in simulator 10 reach desired pressure levels. When simulator 10 idles in this manner, fluid is filtered through low pressure return filter 260. Hydraulic power unit 200 is coupled to control computer 95 as shown in FIG. 4 to enable computer 95 to control start up, operation and shut down of power unit 200.

Referring momentarily to FIG. 1, it is seen that simulator 10 employs a pair of hydraulic actuators 50 to control the roll of cab 15 about longitudinal axis y and to further control the pitch of cab 15 about pivot 52. Hydraulic actuators 50 are situated on the opposed side surfaces 15A and 15B of hull 16. In FIG. 1, only the hydraulic actuator 50 connected to hull side 15A is visible. Actuators 50 form part of the motion system 300 which simulates pitch and roll motion for simulator 10.

Motion system 300 of simulator 10 includes two motion control modules 310 for controlling the motion of respective motion actuators 50. Modules 310 includes a pressure check valve 330 coupled to pressurized hydraulic output line 255 as seen in FIG. 4. In each of motion modules 310, check valve 330 is coupled to a pressure accumulator 340, a dump valve 350 and a servo valve 360, the operation of which is controlled by control computer 95. Motion system 300 further includes piloted operated check valves 370 which are coupled to the respective actuators 50.

Pressure check valves 330 are used to isolate motion modules 310 from pressure drops in the hydraulic power system. Pressure accumulators 340 store sufficient energy to drive actuators 370 through a recoil shock simulator which includes roll and pitch movement of cab 15. Accumulator dump valve 350 is solenoid operated and is used to drain circuit pressure for maintenance purposes.

Servo valves 360 control the direction, velocity and distance travelled by motion actuators 50 based on information supplied by control computer 95 as a function of the particular direction of firing, type of round and charge level sensed by control computer 95. Pilot operated check valves 370 positively lock actuators 50 in position to prevent cylinder drift. Valves 370 also act as a safety to prevent simulator 10 from falling in the event of a hydraulic line hose or valve failure. In this particular embodiment, each of the two hydraulic actuators (motion cylinders) 50 is a balanced cylinder which is trunnion mounted with a hydrostatic bearing supporting the piston rods thereof.

Simulator 10 includes a breech recoil system 400 having a breech recoil control module 60, the operation of which has already been discussed above. For completeness, the schematic diagram of one embodiment of control module 60 is shown in FIG. 4. It will be recalled that breech recoil module 60 drives cylinder/actuators 85 from the "in battery" position to the "recoil position" and then back again to the "in battery" position when the simulated gun is fired by the user.

Breech recoil module 60 includes a pressure check valve 410 coupled to hydraulic fluid output line 255 such that breech recoil system 400 receives pressurized hydraulic fluid. Check valve 410 isolates module 60 from undesired pressure drops in the hydraulic power system. Check valve 410 couples hydraulic fluid line 255 to pressure accumulator 420 as seen in FIG. 4. Accumulator 420 stores sufficient energy to drive breech 25, which is mechanically coupled to actuators 85, through a recoil/counter-recoil cycle simulation. Accumulator 420 is coupled by an accumulator dump valve 430 to hydraulic return line 265. Valve 430 is solenoid operated to enable depressurization of the hydraulic system for component maintenance.

Accumulator 420 is also coupled to a proportional valve 440, the operation of which is controlled by control computer 95. Valve 440 controls the direction of travel, distance of travel and velocity of travel of actuators 85 throughout the recoil/counter-recoil cycle (gun firing cycle) of simulator 10. Actuators 85 are flange mounted balanced cylinders including piston rods supported by hydrostatic bearings. The piston rods have been designated as piston rods 87 and 89. It is noted that breech recoil module 60 includes a flow divider/combiner 450 for providing substantially equal pressurized fluid flow to both of actuators 85 during operation.

Simulator 10 also includes a cab rotation system 500 for enabling the operator to adjust the azimuth of cab 15. Cab rotation system 500 includes a control module 570, a directional control valve 580 and a rotation module 590. Control module 570 includes a pressure accumulator 505 coupled by a pressure check valve 510 to pressurized hydraulic output line 255 as seen in FIG. 4. Pressure check valve 510 retains the charge that accumulator 505 receives from line 255. The accumulator charge is used to drive rotation module 590 and cab rotation motor 550 therein.

An accumulator dump valve 520 is coupled to pressure check valve 510 to enable pressure to be drained from the hydraulic system during system maintenance. Module 570 includes a solenoid lockout valve 530 which is used in conjunction with a palm controller grip (not shown) to permit azimuth adjustment of the cab only when the operator depresses the palm grip.

Directional control valve 580 is manually operated via a control handle (not shown). The operator can use the control handle to control the direction of rotation of cab 15 as well as motor speed. Flow control valve 540 limits the maximum speed at which at which rotation motor 550 rotates. Rotation module 590 includes a counterbalance valve 560 for providing overrunning load control, anti-cavitation control and deceleration control of hydraulic motor 550.

Simulator 10 still further includes a gun elevation system 600 having a control module 605, directional hand control valves 630 and an elevation actuator 640. A pressure check valve 680 is used to couple an pressure accumulator 690 to hydraulic fluid output line 255 as shown in FIG. 4. Valve 680 isolates elevation control module 605 from pressure drops in the hydraulic system. Pressure accumulator 690 is used to drive elevation actuator 640 to the position commanded by the operator. Actuator 640 is mechanically coupled to gun tube 20 (FIG. 1) in a manner which enables gun tube 20 to be raised and lowered as commanded by the operator. More particularly, elevation actuator 640 is a clevis mounted, differential area cylinder. A pilot-to-open check valve 650 is located adjacent actuator 640 to prevent cylinder drift or gun tube 20 from falling in case of failure.

Elevation control module 605 includes a solenoid lock-out valve 610 for use in conjunction with the controller palm grips (not shown) to permit gun tube elevation changes only when such palm grips are depressed by the operator. Flow control valve 620 limits the maximum velocity of actuator 640 according to the actual velocity exhibited by the particular gun to be simulated.

It is noted that directional control valves 630 are plumbed in parallel to control the direction of actuator 640 and the velocity thereof. Accumulator dump valve 645 is used to depressurize the hydraulic system during maintenance.

Figure 5:
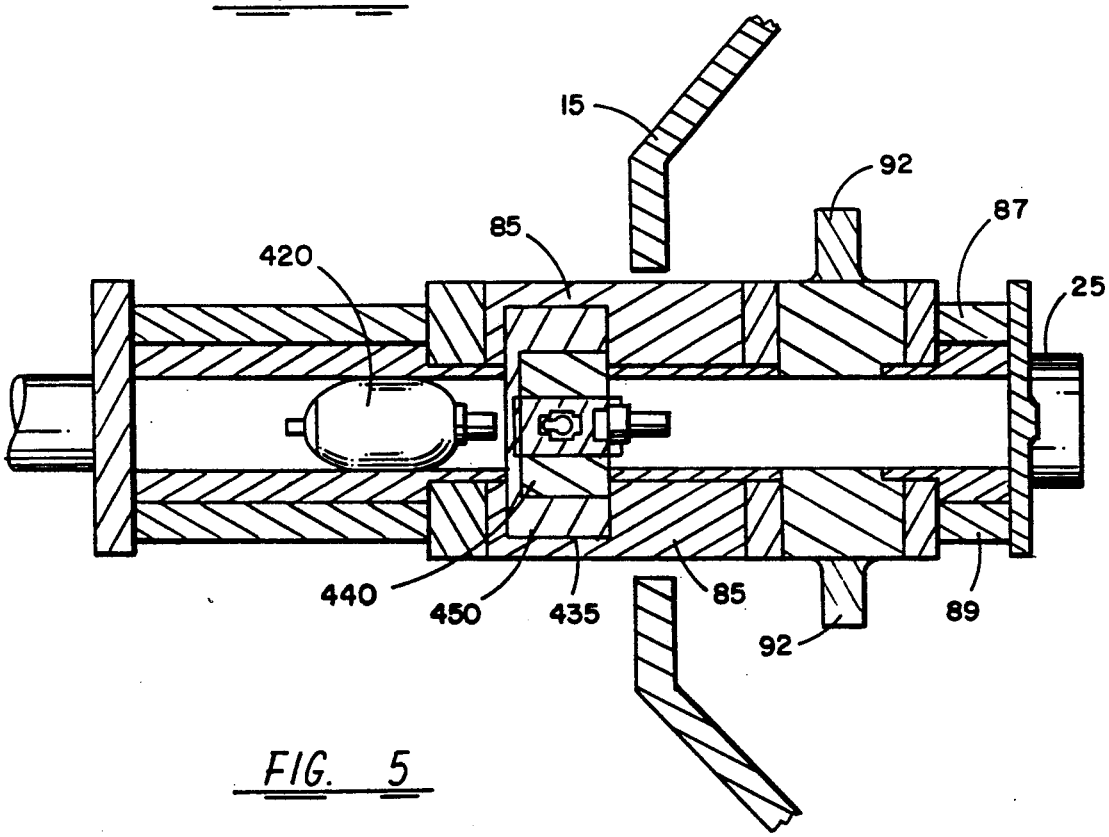
FIG. 5 is a cross sectional view of a portion of the simulator taken along section line 5—5 in FIG. 1.

FIG. 5 is a cross sectional view of a portion of simulator 10 taken along section line 5—5 of FIG. 1. The breech 25 for receiving a round 28 (not shown) is depicted as being connected to piston rods 87 and 89 of cylinder actuators 85 so that breech 25 experiences simulated recoil and counter-recoil motion as explained earlier. Mounting trunnions 92 are shown for connecting gun simulator assembly to gun mount. Simulator 10 includes a feed assembly 435 for receiving pressurized hydraulic fluid. Feed assembly 435 includes a proportional valve 440 and flow divider/combiner 450.

It will be recalled from earlier discussion that throughout the gun firing cycle which includes both recoil and counter-recoil, the external gun tube or barrel 20 remains stationary. In this manner, the likelihood of personnel external to simulator being exposed to potentially dangerous gun tube motion is reduced. Since breech 25 is moved from the "in battery position" to the "recoil position" and back to the "in battery position" by the action of cylinders 85 and pistons 87 and 89, the personnel inside cab 15 will experience a realistic gun firing cycle even though gun tube 20 remains stationary.

Figure 6:
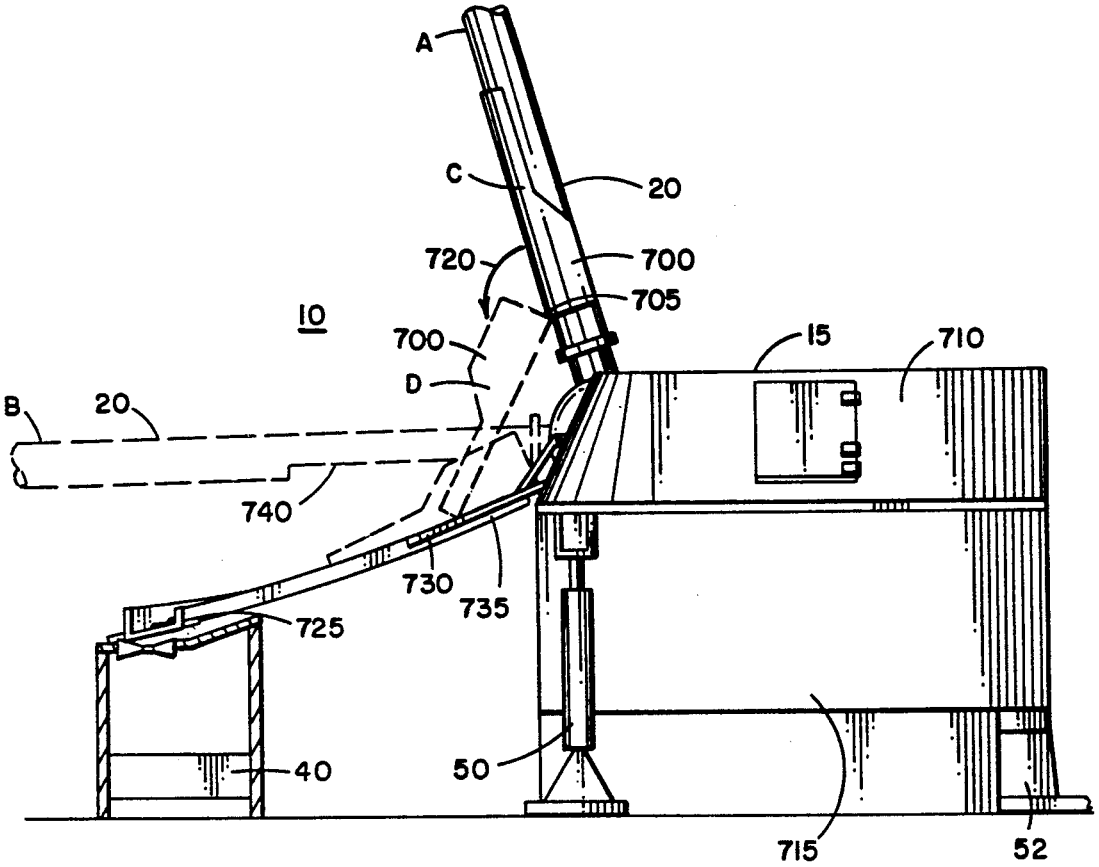
FIG. 6 is a side view of the simulator showing the gun tube at its maximum elevation in position A and at it minimum elevation in position B.

FIG. 6 is a side view of simulator 10 showing gun tube 20 at its maximum elevation in position A and at it minimum elevation in position B. For purposes of discussion of ammunition removal from simulator 10, it is assumed that gun tube 20 of simulator 10 is situated in position A.

Upper ammunition chute 700 is swingably mounted about a hinge 705 such that chute 700 is capable of swinging downwardly from position C to position D as indicated by arrow 720. More particularly, to remove a simulated round from breech 25 (not visible in FIG. 6), when the operator engages the gun firing lever to fire the gun, this action actuates a latch (not shown) which in turn releases the free end of upper chute 700. Chute 700 then is lowered from position C to position D. The hinge point of chute 700 and the corresponding opening in gun tube 20 are positioned close to the round in its rammed position at breech 25. This enables the spent simulated round to travel down upper chute 700 to lower chute 725 without assistance. Gravity causes the spent round to move down lower chute 725 to ammunition transport table 40 which is shown in cross section in FIG. 6. Lower chute supports 730 and 735 are connected to lower chute 725 to provide structural support thereto. It is noted that lower chute 725 is part of chute 35 depicted in FIG. 1.

Figure 7:
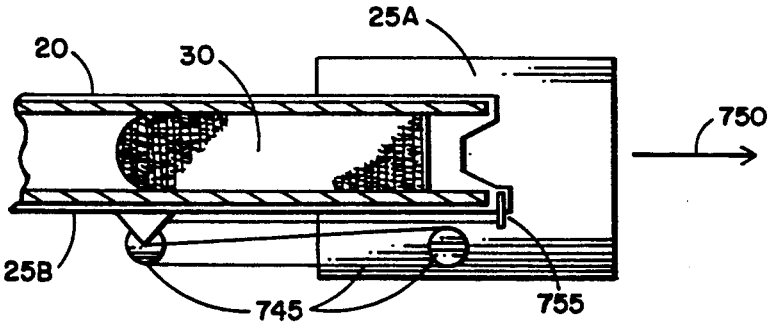
FIG. 7 is a pulley and wire system for moving charges out of the breech of the simulator.

To remove charge 30 from breech 25, charge 30 is moved linearly through the gun tube opening 740 (visible in position B) to upper chute 700. This linear movement is provided by a pulley and wire system 745 such as shown in FIG. 7 for purposes of example. FIG. 7 shows a charge 30 loaded in breech 25. Breech 25 includes a recoiling portion 25A which recoils in the direction of arrow 750 and further includes a fixed portion 25B which is attached to fixed gun tube 20. This system provides sufficient linear movement of charge 30 for a drive finger 755 to propel charge 30 into the desired position for ejection.

Figure 8:
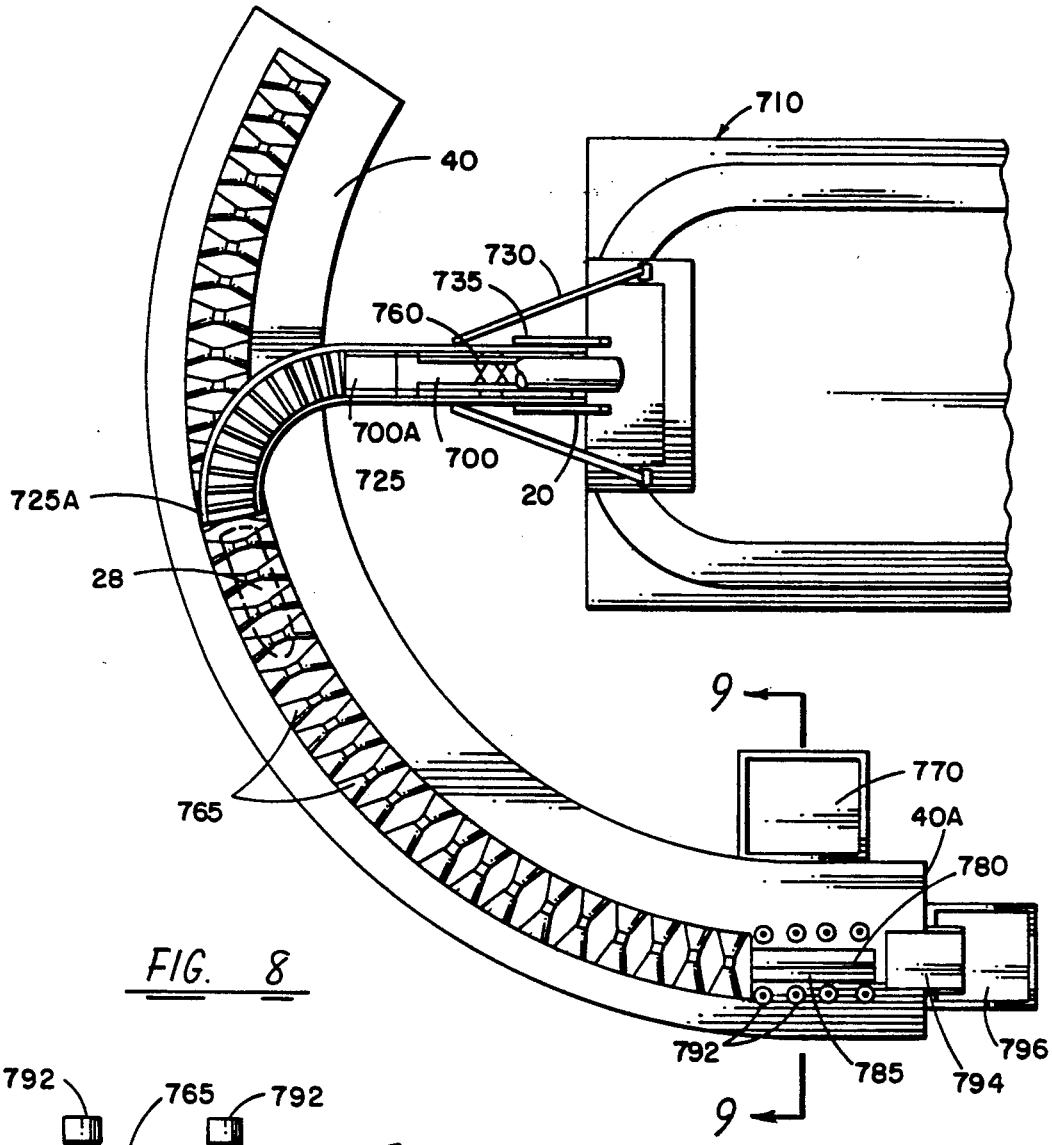
FIG. 8 is a top view of the simulator showing apparatus for extracting a spent round from the breech and for transporting the round to a storage area.

FIG. 8 is a top view of simulator 10 which depicts ammunition transport table 40 in detail. In FIG. 8, a portion of gun tube 20 has been cut away for clarity. In one embodiment of the invention, a hydraulic actuator (not shown) is attached to upper chute 700 to regulate the upper chute lowering rate. At exit 700A of upper chute 700, a spring loaded gate (not shown) is incorporated to prevent round 28 from leaving until chute 700 is fully depressed or lowered onto lower chute 725. As seen in FIG. 8, two rows of tapered "V" rollers 760 are fitted to upper chute 700 to provide both a low resistance to round motion and to further provide positive guidance for the round. As illustrated, lower chute 725 is mounted to cab 15 such that lower chute 725 and upper chute 700 move and rotate together with cab 710 as the azimuth of gun tube 20 is changed by the gun operator.

As round 28 begins to leave lower chute 725 at lower chute exit 725A, round 28 makes contact with a series of rubber coated, chain-driven rollers 765 mounted to transport table 40. Rollers 765 transport round 28 to a collection area 770. The surface of powered roller 765 which contacts rounds 30 is conically or "V" shaped to assure that round 30 is held in contact with drive wheels 765.

Figure 9:
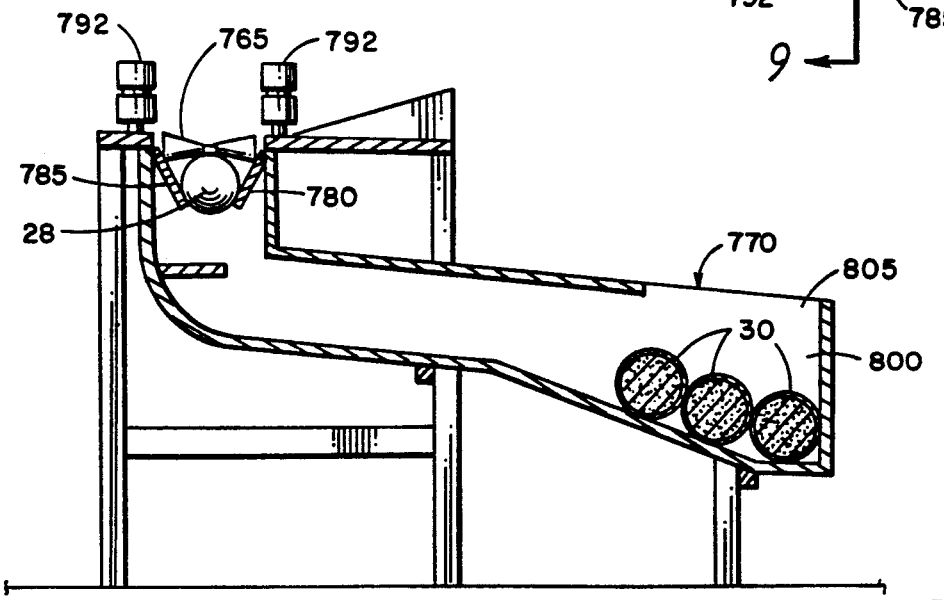
FIG. 9 is a side cross sectional view of the transport, table and store bin along section line 9—9 of FIG. 8.

As a round 28 approaches the lower end 40A of transport table 40, round 28 engages shutters 780 and 785. As seen more clearly in FIG. 9, shutter 780 is a latched spring return shutter and shutter 785 is a spring loaded shutter. The aforementioned rubber coated driven rollers 765 are readily observed in FIG. 9. A drive chain (not shown) extends along and contacts all of drive wheels 765 to provide driving force thereto. Guide wheels 792 are used to guide round 28 onto shutters 780 and 785. When a round 28 engages spring loaded shutters 780 and 785, the round falls through such shutters and rolls into collection bin 800 of storage area 45. Collection bin 800 includes an opening 805 to enable rounds to be removed from simulator 10 for re-use at a later time.

Simulated changes 30, are much lighter and pass over doors 780 and 785. Charge 30 is pushed into discharge chute 794 by the upcoming round 28. Charge 30 slides down chute 794 into storage bin 796.

Figure 10:
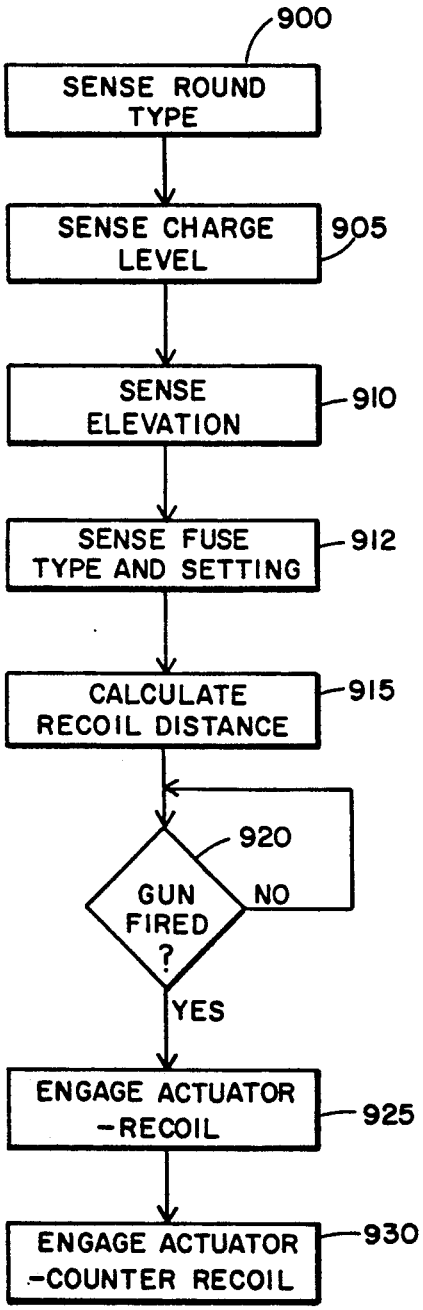
FIG. 10 is a simplified flowchart showing the operation of the control computer of the simulator.

FIG. 10 is a simplified flowchart which sets forth the operation of control computer 95 as it controls the operation of simulator 10. As a round is inserted into breech 25 of simulator 10, simulator 10 senses the type of the round as per block 900. Control computer 95 then senses the charge level inserted in the breech as per block 905. Computer 95 also senses the elevation to which gun tube 20 is set at block 910 and the fuse type and setting, block 912. Using the information thus provided to computer 95, at block 915 computer 95 calculates the appropriate recoil distance for breech 25 to be moved when the round is later fired. Computer 95 monitors to see when simulator 10 is fired by the operator at block 920. When simulator 10 is finally fired by the operator, control computer engages hydraulic actuator 85 to move breech 25 an appropriate distance to a recoil position as per block 925. Then, control computer 95 immediately engages hydraulic actuator 85 to move breech 25 back to its original position to simulate counter-recoil as per block 930.

Figure 11:
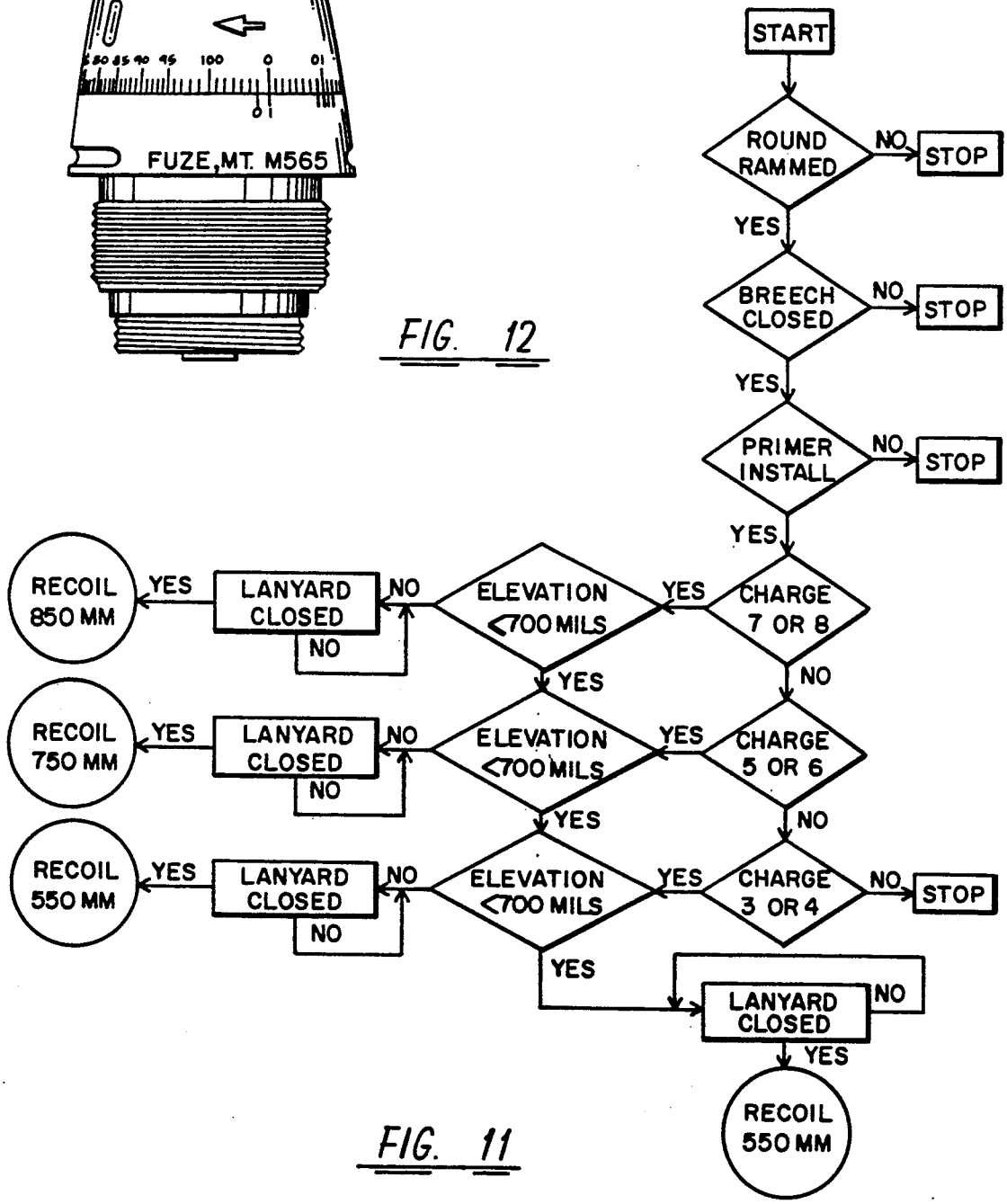
FIG. 11 is a more detailed flowchart showing the operation of the control computer of the simulator.

FIG. 11 is a more detailed flowchart which shows the operation of control computer 95 as it senses whether the round has been rammed, the breech has been closed, the particular charge level used by the operator, the elevation set by the operator, the round type employed. Computer 95 then uses this information to determine the amount of recoil which is appropriate for breech 25 to exhibit.

The foregoing describes a simulated artillery gun apparatus and method of operation thereof. The disclosed simulator employs a unique hydraulic system to move the breech of a gun through the recoil and counter-recoil motions when a simulated projectile is fired by the gun. The disclosed simulator apparatus lessens the danger associated with artillery simulation because the gun tube of the simulator remains stationary while the breech mechanism reciprocates to emulate recoil and counter recoil. In the present simulator, different types of rounds are provided with different frequency resonant circuits to permit the simulator to identify the particular type of round which the operator has loaded into the gun. The simulator includes a mechanism for automatically expelling and collecting the fired round for re-use at a later time. It is also noted that a separate fuse (not shown) is preferably provided for attaching to each round. Each fuse includes its own transmitter for transmitting data to computer 95 indicating the fuse setting and type. The fuse does not affect the record-/counter recoil cycle and is therefore not discussed in detail.

While only certain preferred features of the invention have been shown by way of illustration, many modifications and changes will occur to those skilled in the art. It is, therefore, to be understood that the present claims are intended to cover all such modifications and changes which fall within the true spirit of the invention.

What is claimed is:

1. An artillery gun simulator comprising:

a gun tube;

supporting means, connected to said gun tube, for supporting said gun tube;

a simulated breech assembly, for receiving a simulated round therein, said breech assembly being movably mounted with respect to said tube, such that said breech assembly is movable between an in battery position and a recoil position by reciprocating action;

a source of pressurized hydraulic fluid;

a double acting hydraulic cylinder, mechanically coupled to said breech assembly and fluidically coupled to said source such that said source positively drives said cylinder and breech assembly from the in battery position to the recoil position to simulate breech recoil and then said source positively drives said cylinder and breech assembly from said recoil position to the in battery position to simulate breech counter-recoil; and means for holding said gun tube in a fixed position during recoil and counter-coil of said breech assembly.

2. The artillery gun simulator of claim 1 wherein said breech is adapted to receive a plurality of charge bags therein, each charge bag including a resonant circuit exhibiting a different resonant frequency, said simulator further comprising:

sensing means for sensing the resonant frequencies exhibited by the resonant circuits of all of the charge bags of a particular round loaded into the breech of said gun; and counting mean for counting the number of different resonant frequencies sensed by said sensing means to determine the charge level of said particular round.

3. An artillery gun simulator comprising:

a gun tube;

supporting means, connected to said gun tube, for supporting said gun tube;

a simulated breech assembly, for receiving a simulated round therein, said breech assembly being movably mounted with respect to said tube, such that said breech assembly is movable between an in battery position and a recoil position by reciprocating action;

a source of pressurized hydraulic fluid;

a double acting hydraulic cylinder, mechanically coupled to said breech assembly and fluidically coupled to said source such that said source positively drives said cylinder and breech assembly from the in battery position to the recoil position to simulate breech recoil and then said source positively drives said cylinder and breech assembly from said recoil position to the in battery position to simulate breech counter-recoil;

means for holding said gun tube in a fixed position during recoil and counter-recoil of said breech assembly;

said breech being adapted for receiving a plurality of different types of rounds therein, each of said different type of rounds having a respective resonant circuit therein exhibiting a different resonant frequency corresponding to the type of round; and sensing means in said simulator for sensing the resonant frequency of a particular round loaded into the breech of said gun to identify the type of round loaded in to said breech.

4. The artillery gun simulator of claim 3 wherein said round is adapted for receiving a variety of simulated fuses, each of said fuses including a transmitting circuit for transmitting a predetermined code upon interrogation, said code identifying a type of fuse and a fuse time setting, said simulator further comprising:

sensing means for interrogating and receiving the predetermined codes from the transmitting circuit of the fuse of a round loaded into the breech of said gun; and detection means for identifying the predetermined received code for identifying the fuse type and time setting of the fuse installed into the round inserted into said breech.

5. The artillery gun simulator of claim 3 wherein said gun tube includes an opening through which rounds can exit, said simulator further comprising:

extraction means for expelling said round from the breech of said simulator into said opening in said gun tube;

an first chute swingably mounted below said opening to receive the round extracted by said extracting means;

a second chute for receiving said round when said round exits said first chute; and conveying means for receiving rounds exiting from said lower chute and for convey such rounds to a storage area.

* * * * *